United States Patent [19]

Landry et al.

[11] Patent Number: 4,558,468

[45] Date of Patent: Dec. 17, 1985

[54] SURGICAL GOWN HAVING ONE-PIECE-BELT SYSTEM

[75] Inventors: Anne D. Landry, Cincinnati; Albert L. Bayes, Cleves, both of Ohio

[73] Assignee: The Kendall Company, Boston, Mass.

[21] Appl. No.: 658,328

[22] Filed: Oct. 5, 1984

[51] Int. Cl.[4] ..... A41B 13/10

[52] U.S. Cl. ..... 2/51; 2/114

[58] Field of Search ..... 2/51, 114, DIG. 7

[56] References Cited

U.S. PATENT DOCUMENTS

| | | | |
|---|---|---|---|
| 3,359,569 | 12/1967 | Rotanz | 2/114 |
| 3,594,818 | 7/1971 | Planner | 2/114 |
| 3,648,290 | 3/1972 | Hartigan | 2/114 |
| 3,721,999 | 3/1973 | Goya et al. | 2/114 |
| 3,754,284 | 8/1973 | Hartigan et al. | 2/114 |
| 3,864,757 | 2/1975 | Hartigan | 2/114 |
| 3,935,596 | 2/1976 | Allen, Jr. et al. | 2/114 |
| 4,019,207 | 4/1977 | Newman et al. | 2/51 |
| 4,075,716 | 2/1978 | Collins | 2/114 |
| 4,255,818 | 3/1981 | Crowley et al. | 2/51 |
| 4,290,148 | 9/1981 | Roberts | 2/51 |
| 4,326,300 | 4/1982 | Bolton et al. | 2/114 |
| 4,371,986 | 2/1983 | Wichman | 2/51 |
| 4,384,370 | 5/1983 | Singer | 2/51 |
| 4,395,782 | 8/1983 | Reynolds | 2/114 |

*Primary Examiner*—Doris L. Troutman

*Attorney, Agent, or Firm*—Donald N. Halgren

[57] ABSTRACT

A rear-closure surgical gown having a one-piece-belt system is disclosed in which either sterile or nonsterile gowning assistance can be used. One end of the belt is releasably attached to the front of the gown. The other end of the belt is releasably attached to a transfer device. The transfer device is releasably attached to the front portion of the gown. The belt is looped through a tunnel disposed on the gown by a belt hanger so as to insure sterility of the belt. The middle section of the belt is releasably attached to the back margin of the gown. These features enable positive closure of the gown, and enable both vertical and circumferential adjustment of the belt with respect to the wearer.

13 Claims, 9 Drawing Figures

SURGICAL GOWN HAVING ONE-PIECE-BELT SYSTEM

BACKGROUND OF THE INVENTION

1. Field of the Invention

The invention relates to gowns for use in surgical operations where sterility is required and, more particularly, to a belt system for such a gown.

2. Background Art

Most surgical gowns are of the rear-closure type in order to insure the sterility of the gown and to provide better liquid and bacterial strikethrough resistance in the front portion of the gown. The gown body is generally constructed with a front portion and two rear or back margins, the back margins being of sufficient width to wrap around the back of the wearer and to partially overlap each other when the gown is secured on the wearer. The gown usually has a belt system in order to so secure the gown on the wearer.

Donning such a rear-closure gown presents a sterility problem because proper sterile technique dictates that the wearer may not touch the back margins nor reach behind the back. In addition, any part of the gown below operating table level is considered a nonsterile zone, so that if the belt falls below operating table level or the wearer touches the belt below operating table level, the gown is considered contaminated and the entire gown must be removed and a new one donned. Therefore, the wearer should keep his hands above about waist level and in front.

Because of the sterility problems associated with rear-closure gowns, the belt system must be secured to the front of the gown. This requirement leads to severe design problems. The belting system must not only provide a positive closure for the back of the gown, but it must also comply with all of the sterility requirements, remain easy to don, and provide comfort for the wearer.

One type of belt system that is generally known in the art is a two-piece belt system in which each of two discrete belts have one fixed end and one free end. One belt is generally attached to the right back margin of the gown, and the other is attached to the wearer's left on the front portion of the gown. The righthand belt section is brought around the back of the gown and is tied to the lefthand belt section on the left side of the gown.

Two-piece-belt systems offer the advantage of allowing both sterile and nonsterile personnel to assist the wearer in donning the gown. Sterile assistance is made possible by the use of a transfer device attached to front of the gown, such that the sterile assistant need only touch the transfer device, not the gown. Examples of this type of belt system are disclosed in U.S. Pat. No. 3,935,596 issued Feb. 3, 1976, to Allen et al.; U.S. Pat. No. 4,019,207 issued Apr. 26, 1977, to Newman et al.; U.S. Pat. No. 4,255,818 issued Mar. 17, 1981, to Crowley et al.; U.S. Pat. No. 4,371,986 issued Feb. 8, 1983, to Wichman; and U.S. Pat. No. 4,451,931 issued June 5, 1984, to Wichman.

However, two-piece-belt systems also have several disadvantages. When a two-piece belt is tied around the waist, excess gown fabric gathers at the sides and the front of the gown because of the fixed ends. This "blousing" can compromise sterile technique if the excess fabric touches a nonsterile object. Blousing can also cause the back gown edge to gap open and expose, for example, the wearer's unsterile scrub suit. This gathering of fabric also tends to decrease the comfort of the wearer.

Another disadvantage of two-piece-belt systems is that because the ends of each belt are permanently secured to the gown body, the fixed ends of the belt may tear out if the belt is tightly cinched around the waist when the wearer bends at the waist. These tear-outs can effect the sterility of the gown by allowing liquid and bacterial strikethrough.

Another disadvantage of two-piece-belt systems is that because the two belts are permanently secured to the gown body, there can be no adjustment of the belt system to accommodate different size wearers thereby reducing the comfort of the gown. The fixed ends of the belt also do not allow vertical or circumferential adjustment of the belt around the wearer's waist.

One-piece-belt systems have been used to try to solve some of the tear-out and comfort problems. Examples of one-piece-belt systems are disclosed in U.S. Pat. No. 3,359,569 issued Dec. 26, 1967, to Rotanz et al.; U.S. Pat. No. 3,594,818 issued July 27, 1971, to Planner; U.S. Pat. No. 3,648,290 issued Mar. 14, 1972, to Hartigan; U.S. Pat. No. 3,721,999 issued Mar. 27, 1973, to Goya et al.; U.S. Pat. No. 3,864,757 issued Feb. 11, 1975 issued to Hartigan; U.S. Pat. No. 4,075,716 issued Feb. 28, 1978, to Collins. However, a major ongoing disadvantage of one-piece belts is that only a nonsterile person can assist the wearer. That is, because one end of the belt is attached to the back margin of the gown, a nonsterile area, a sterile assistant would compromise their own sterility by touching the back margin to help secure the belt. For this same reason, the wearer cannot self-belt.

It is therefore an object of the present invention to provide a rear-closure surgical gown having a novel one-piece-belt system.

It is a further object of this invention to provide a rear-closure surgical gown having a one-piece-belt system allowing either sterile or nonsterile assistance or self-gowning.

It is also an object of this invention to provide a rear-closure surgical gown having a one-piece-belt system which provides more comfort to the wearer by providing circumferential and vertical freedom of the belt while maintaining the required sterility of the gown.

It is another object of this invention to provide a rear-closure surgical gown having a one-piece-belt system which provides a positive closure for the back of the gown while eliminating blousing of the fabric about the middle of gown.

It is a still further object of this invention to provide a rear-closure surgical gown having a one-piece-belt system which is easy to don while insuring the sterility of the gown.

It is a yet another object of this invention to eliminate tear-outs associated with surgical belts by providing a completely detachable belt for a rear-closure surgical gown.

SUMMARY OF THE INVENTION

The present invention provides an improved rear-closure surgical gown, the gown having a one-piece-belt system.

A principal feature of the present invention is that the belt may be completely detached from the gown body. This feature allows both vertical and circumferential adjustment of the belt about the wearer. Belt tear-outs common to other surgical gowns are eliminated because the belt is not permanently affixed to any portion of the gown.

Another feature of the present invention is that the belt may be vertically or circumferentially adjusted on the wearer without compromising the sterility of the gown body. A belt hanger is associated with the gown to form a tunnel though which the belt is looped. This prevents the belt from falling below operating table level during vertical adjustment, and also shields the belt on the nonsterile back margin of the gown, thereby allowing sterile circumferential adjustment.

A further feature of this invention is that a rear-closure surgical gown with a one-piece-belt system can be secured with the assistance of either nonsterile or sterile personnel. The gown can also be self-donned.

Yet another feature of the invention is that the gown can be securely closed at the rear and tightly cinched around the waist without precipitating blousing of the gown body fabric which might otherwise compromise sterile gowning technique.

Additional features of the present invention are discussed in the following description, and embodied in the claims.

DETAILED DESCRIPTION OF THE INVENTION

Figure 1:
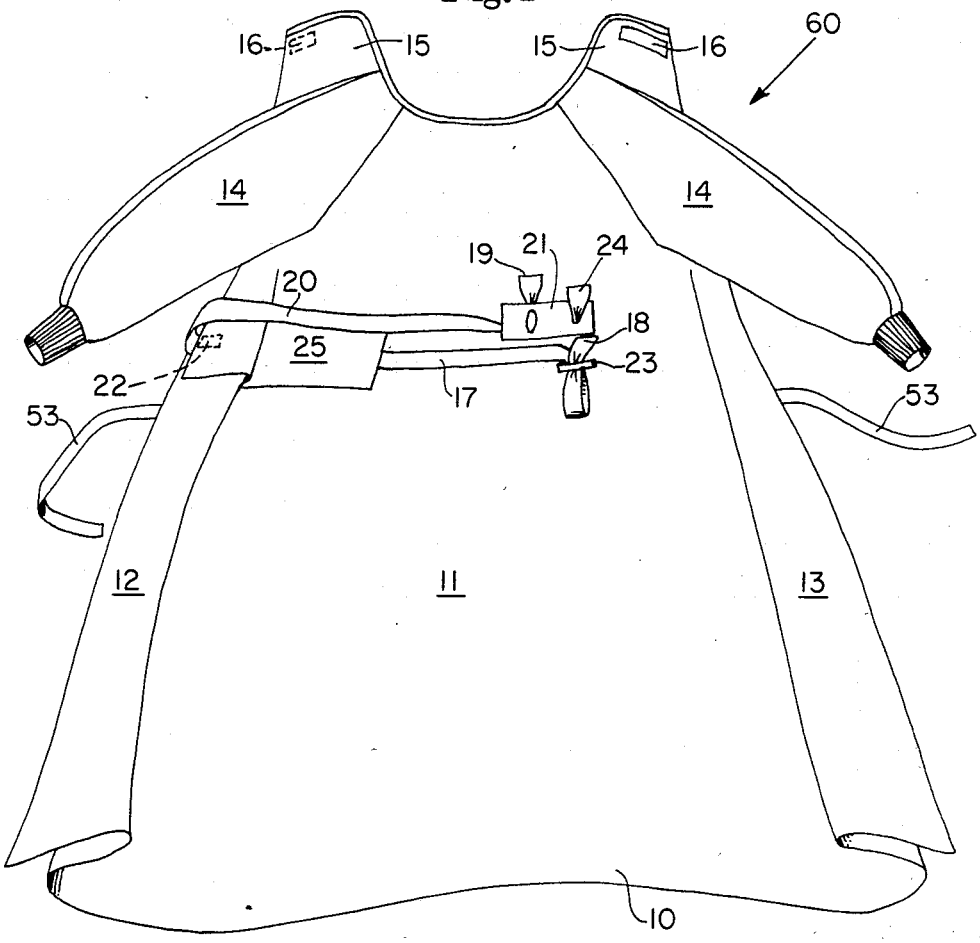
FIG. 1 is a front elevational view of an exemplary surgical gown embodying the present invention.

FIG. 1 shows a front elevational view of a rear-closure surgical gown, the surgical gown being generally designated 60. The surgical gown 60 comprises a gown body 10 comprising a front section 11 and two back margins 12 and 13; sleeves 14; neck portions 15 and cooperating closure means 16; inner ties 53; and a belt system comprising a belt 17 having a first end 18, a second end 19 and a middle section 20, and means for associating the belt 17 with the gown body 10. The means for associating the belt 17 with the gown body 10 comprise a transfer device 21; means such as double-sided adhesive tape 22 for releasably attaching a segment of the middle section 20 of the belt 17 to the gown body 10; means such as a loop 23 for releasably attaching the first end 18 of the belt 17 to the front portion 11 of the gown body 10; means such as a tab 24 for releasably attaching the transfer device 21 to the front portion 11 of the gown body 10; and means for releasably attaching the second end 19 of the belt 17 to the transfer device 21. The associating means of FIG. 1 also comprises means for engaging the belt 17 in slideable relation with the gown body 10 such as by a belt hanger 25.

Referring to the gown embodiment of the present invention shown in FIG. 1, the present invention provides a surgical gown which has a one-piece-belt system which enables such a gown to be donned by a wearer through the aid of a sterile assistant, a nonsterile assistant, or by the wearer without assistance. The manner in which this may be done is described hereinafter after discussing the elements of the gown in more detail below.

Still referring to the gown body 10 of FIG. 1, surgical gown 60 comprises a front portion 11, a first back margin 12, and a second back margin 13. As shown in FIG. 1, the first back margin 12 is disposed on the right side of the wearer for ease in description of the location of the belting means. However, the arrangement of the belting means can be reversed, thereby placing them on the left side of the gown body 10.

The gown body 10 may be constructed of any well known and suitable material for disposable or reusable gowns such as a woven or nonwoven fabric. A preferred fabric is a disposable fabric such as is described in U.S. Pat. No. 4,196,245 issued Apr. 1, 1980 to Kitson et al., although a reusable fabric is an alternative embodiment.

Sleeves 14 are attached to the gown body 10, FIG. 1, in a conventional manner. The neck portion 15 is provided with cooperating closure means 16, the closure means constructed of VELCRO® or snaps or any other suitable means so as to adjust for variations in the neck size of the wearer. The gown may also be provided with inner ties 53 generally known in the art which are attached to the inside of the back margins 12 and 13 so as to provide an additional means for achieving positive gown closure.

Figure 2:
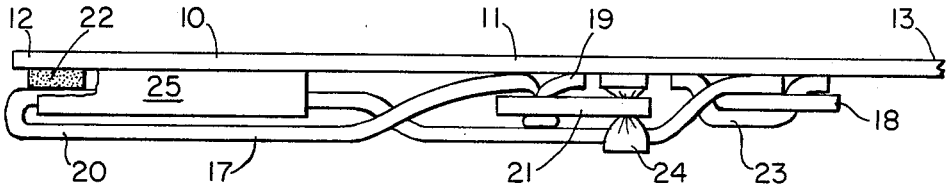
FIG. 2 is a top view of the belt system of the gown of FIG. 1 with a partially cut-away section to illustrate the double-sided adhesive tape attaching means, the belt hanger, and how the belt is configured in the tunnel formed by the belt hanger.

FIGS. 1 and 2 show front elevational and top views of a preferred assembly for the belt system. A belt 17 is constructed of one piece of fabric having sufficient length to completely encircle the gown body 10. The belt 17 has a first end 18, a second end 19, and a middle section 20. The belt 17 and the components of the belt system can be made of any suitable material such as a woven or nonwoven fabric, although a preferred material is the same material as the material used for the gown body 10.

The belt 17 is associated with the gown body 10 by means comprising a transfer device 21; means such as double-sided adhesive tape 22 for releasably attaching a segment of the middle section 20 of belt 17 to the gown body 10; and means such as a loop 23 for releasably attaching the first end 18 of belt 17 to the front portion 11 of the gown body 10. The transfer device 21 releasably attaches the second end 19 of belt 17, while the transfer device 21 is releasably attached to the front portion 11 of the gown body 10 by means such as a tab 24.

Figure 3:
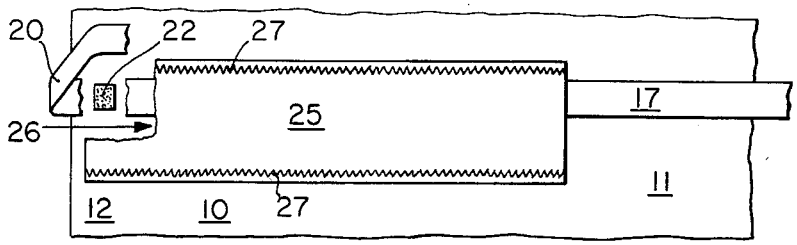
FIG. 3 is an enlarged scale, fragmentary sectional view of the belt hanger assembly attached to the first back margin of the gown of FIG. 1 with a partially cut-away section to illustrate the double-sided adhesive tape attaching means, the belt hanger, and how the belt is configured in the tunnel formed by the belt hanger.

FIGS. 1 and 2 also shows means for engaging belt 17 in a longitudinal, adjacent and slideable relation with the gown body 10. Such a relation is achieved by means such as a belt hanger 25. In FIG. 3, an enlarged scale, partial cut-away view of the belt hanger assembly is shown. Although these means may be constructed of belt loops or other types of hangers generally known in the art, a preferred embodiment is a belt hanger 25 which is constructed of a generally rectangular shaped piece of fabric attached to the gown body 10. A preferable length of the belt hanger 25 is to enable the belt hanger 25 to extend from the first back margin 12 to the front portion 11 of the gown body 10. This allows a major portion of belt 17 to remain covered and therefore sterile during both the donning stage and the circumferential adjusting of belt 17 to fit the wearer. An alternative embodiment is to fan-fold lengths of belt 17 into the belt hanger 25 so as to accommodate even more of the belt 17. The belt hanger 25 has a preferred width of four to five times the width of belt 17. This width of the belt hanger 25 allows vertical adjustment of the belt 17 when the gown is donned. The belt hanger 25 is attached to the gown body 10 by any conventional means such that a tunnel 26 is formed so that the belt 17 can be slid through the tunnel 26. A preferable method of attaching the belt hanger 25 is to use a transfer adhesive tape 27 along the top and bottom widths of the belt hanger 25. A preferable material for the belt hanger 25 is the same material as the gown body 10.

FIG. 3 also shows a partial cut-away view of the means for releasably attaching a segment of the middle section 20 of belt 17 to the gown body 10. The belt 17 may be releasably attached by several means including threading the belt 17 through a loop or slit or tying the belt 17 to the belt hanger. Exemplary means include tension separable means such as VELCRO ®, snaps, or means such as double-sided adhesive tape 22. For example, one surface of the double-sided adhesive tape 22 may be attached to the gown body 10, while the other surface is attached to the belt 17 after the belt 17 has been fed through the tunnel 26. Such double-sided adhesive tape 22 preferably is attached to the gown body 10 at the first back margin 12. The double-sided adhesive tape 22 should be attached close to the edge of the first back margin 12 so that when the assistant brings the belt 17 around the back of the wearer, the first back margin 12 is pulled closed over the second back margin 13, thereby forming a complete closure for the gown. This embodiment also allows the double-sided adhesive tape 22 to be covered by the belt hanger 25 so as to prevent any problems with strikethrough of the gown body 10.

Figure 4:
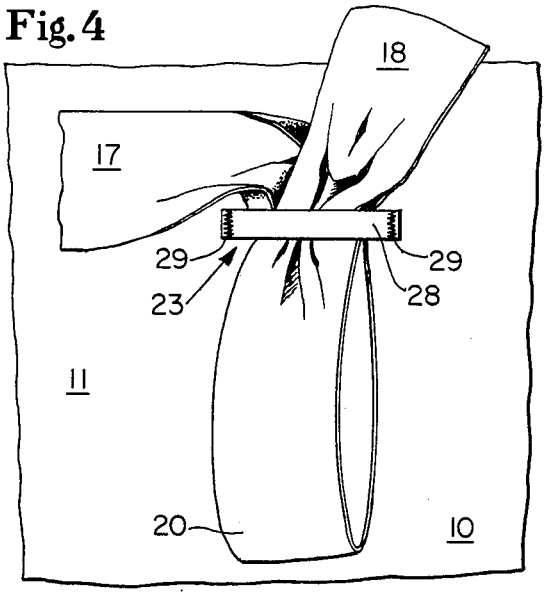
FIG. 4 is an enlarged scale, fragmentary sectional view of the gown of FIG. 1 showing a loop which releasably attaches one end of the belt, and the folded configuration of that end and the middle section of the belt.

FIG. 4 shows an enlarged view of the means for releasably attaching the first end 18 of belt 17 to the front portion 11 of the gown body 10. A preferred means is a loop 23. The loop 23 is formed by attaching a strip of fabric 28 to the front portion 11 of the gown body 10. The ends of the strip of fabric 28 are attached by any conventional attaching means such as by a sewn stitch 29. The loop 23 formed thereby releasably attaches belt 17 by receiving the first end 18 and a segment of the middle section 20 in a folded configuration, such as by folding the belt 17 back upon itself.

Figure 5:
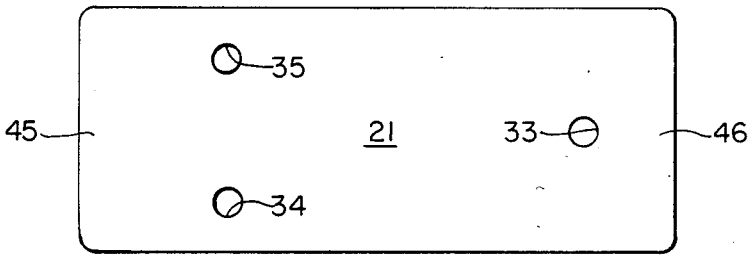
FIG. 5 is an enlarged frontal view of a transfer device which is a component of the gown of FIG. 1.

FIG. 5 shows a preferred embodiment of the transfer device 21. The transfer device 21 may have a general rectangular shape and be made of any suitable material such as cardboard. The transfer device 21 can be divided into a first section 45 which is to be touched only by the wearer and a second section 46 which is to be touched by an assistant or a non-sterile area such as the weight used in self-gowning. These areas can be appropriately marked by different colors. The transfer device has three openings 33–35. Opening 33 is positioned in the second section 46 to releasably engage means such as a tab 24 (see FIG. 6). Openings 34 and 35 are positioned in first section 45 to releasably attach the second end 19 of belt 17.

Figure 6:
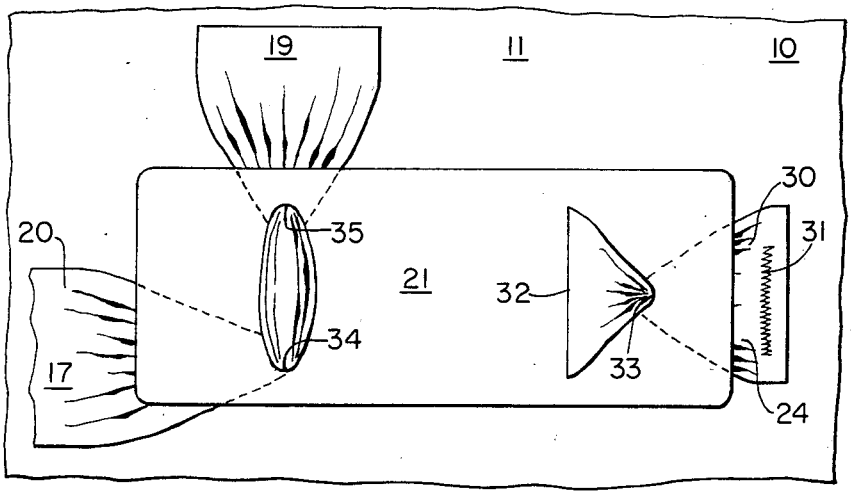
FIG. 6 is an enlarged view of the transfer device of FIG. 5 and a fragmentary portion of the gown of FIG. 1 showing a tab and how the tab releasably attaches the transfer device to a front section of the gown, and a second end of the belt and how it is also releasably attached to the transfer device.

FIG. 6 shows an enlarged view of the transfer device 21 and means which releasably engage it. The transfer device 21 is releasably attached to the front portion 11 of the gown body 10 by means such as tab 24. Tab 24 has a proximal end 30 which is permanently attached to the front portion 11 by any conventional attaching means such as by a sewn stitch 31. Tab 24 also has a distal end 32 which releasably attaches to the transfer device 21. A preferred means for releasably attaching the distal end 32 to the transfer device 21 comprises an opening 33 in the transfer device 21, the opening 33 including such alternative forms as an aperture, a slit, a notch or a groove. Alternative means for releasably attaching tab 24 to the transfer device 21 also include tape, VELCRO ® or glue.

FIG. 6 also shows the means for releasably attaching the second end 19 of belt 17 to the transfer device 21. A preferred method for attaching the second end 19 is through a pair of openings 34 and 35 in the transfer device. The second end 19 is brought through opening 34 and then back through opening 35. This allows the second end 19 to easily detach from the transfer device 21 when the gown is donned. Several alternative means for releasably attaching the second end 19 are available including VELCRO ®, tape, using only one opening or aperture in the transfer device 21, or using a slit or notch in the transfer device 21.

The gown as shown in FIG. 1 is used in the following manner. After the gown is placed on the wearer and the cooperating closure means 16 of the neck portion 15 and the inner ties 53 are secured, the back margins 12 and 13 must be secured together in an overlapping relationship so that the gown is positively closed. The wearer grasps the transfer device 21. With an outward pull, the wearer releases the transfer device 21 from the tab 24. The wearer then hands the transfer device 21 to a sterile or nonsterile assistant or places it under a weight for self-growing. The assistant walks with the transfer device 21 and the second end 19 of belt 17 around the back of the wearer, or the wearer turns to the left to self-gown. The double-sided adhesive tape 22 assures that the first back margin 12 is held tightly against the second back margin 13. As the assistant is passing the transfer device 21 and the second end 19 around the wearer or the wearer is turning to the left, the wearer removes the folded configuration of the first end 18 and the middle section 20 from the loop 23.

When the gown has been closed, the assistant presents the transfer device 21 to the wearer or the wearer again grasps the transfer device from under the weight in self-gowning. The wearer then pulls the second end 19 of the belt 17 from the transfer device 21.

The middle section 20 of the belt 17 detaches from the two-sided adhesive tape 22 either as the assistant walks the transfer device 21 around the back of the wearer or as the wearer tugs on the second end 19 of the belt 17 in preparation for securing both ends together. The belt 17 is now completely detached from the gown body 10, although the belt hanger 25 does prevent the belt 17 from slipping below the waist area into a non-sterile zone. The wearer can now adjust the belt 17 vertically to fit any particular needs. Because the belt 17 is contained in the belt hanger 25 and is constructed of only one piece, the wearer may also circumferentially adjust the belt 17 without compromising the sterility of the front portion 11 of the gown body 10. The wearer then ties the two belt ends together. The one-piece belt construction not only allows the wearer to cinch the belt 17 around the waist as tightly as desired, but also eliminates both blousing at the front portion 11 of the gown body 10 and belt tear-outs, and keeps the back margins 12 and 13 flat against the wearer's back so as to prevent gapping open of the back margins 12 and 13.

Figure 7:
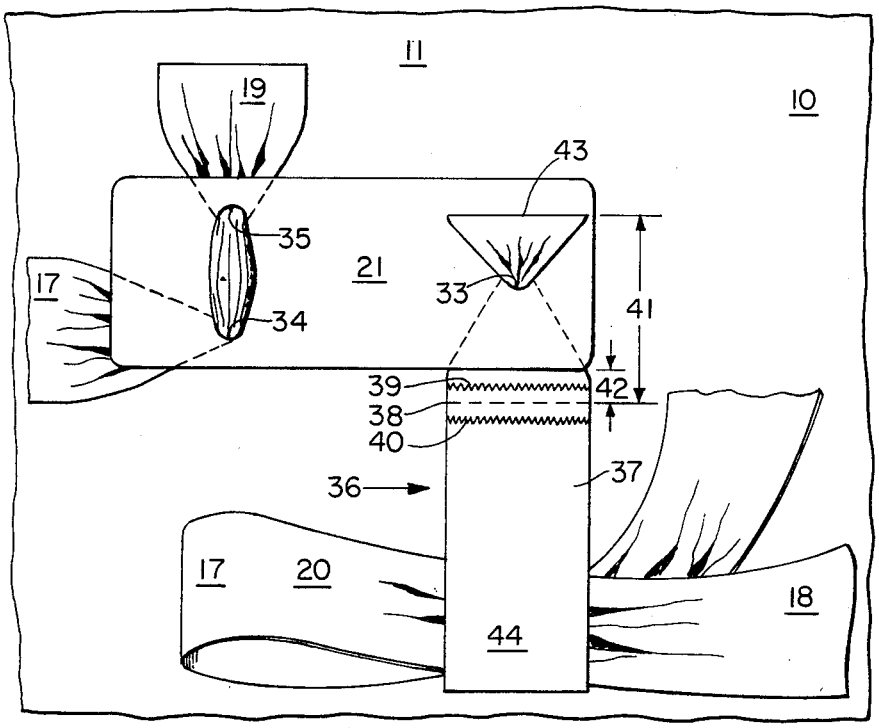
FIG. 7 is an enlarged scale, fragmentary view of an alternative surgical gown embodiment of the present invention showing an alternate associating means for the belt system of the gown.

FIG. 7 is an enlarged view of alternative means for associating the belt 17 to the gown body 10. The means for releasably attaching the first end 18 and the means for releasably attaching the transfer device 21 are combined in a unitary system such as a belt end holder 36. The belt end holder 36 is formed by a strip of fabric 37 with its ends 38 folded back upon themselves and attached to the gown by any conventional securing means such as sewn stitches 39 and 40. This configuration creates a tab portion 41 similar to tab 24 shown in FIG. 6. Tab portion 41 has a proximal end 42 and a distal end 43. The distal end 43 releasably attaches the transfer device 21 to the front portion 11 of the gown body 10. A loop portion 44 is also formed. The loop portion 44 is similar in function to loop 23 of FIG. 4 in that it releasably attaches belt 17 by receiving the first end 18 and a segment of the middle section 20 of the belt 17 in a folded configuration, such as by folding the belt 17 back upon itself. The one significant difference between loop 23 and loop portion 44 is that loop portion 44 receives the folded configuration in the horizontal rather than the vertical direction.

The gown incorporating the alternative embodiment shown in FIG. 7 is donned in the same manner as the gown embodiment of FIG. 1 except that the wearer releases the transfer device 21 from the distal end 43 of the tab portion 41 of the belt end holder 36 and removes the folded configuration of the first end 18 and the middle section 20 of the belt 17 from the loop portion 44.

Figure 8:
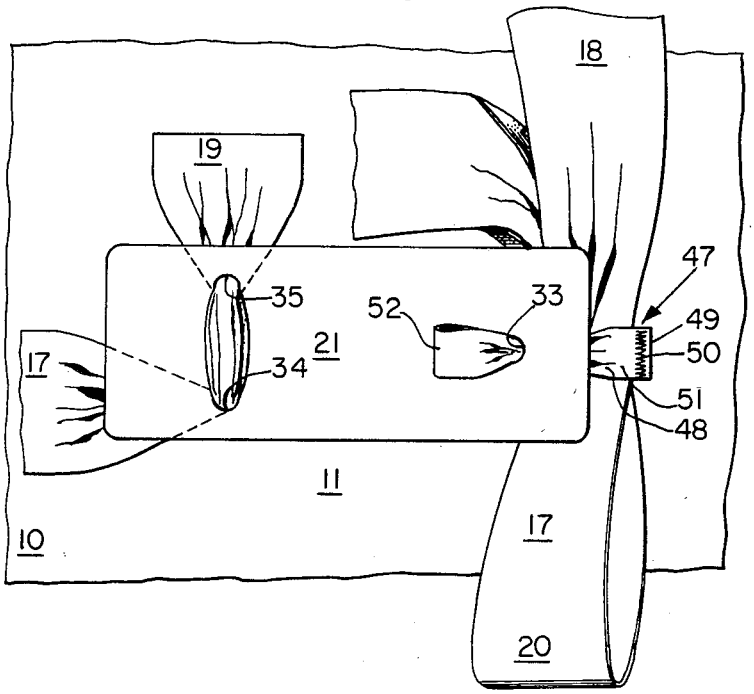
FIG. 8 is an enlarged scale, fragmentary view of another alternative surgical gown embodiment of the present invention showing another alternate associating means for the belt system of the gown.
Figure 9:
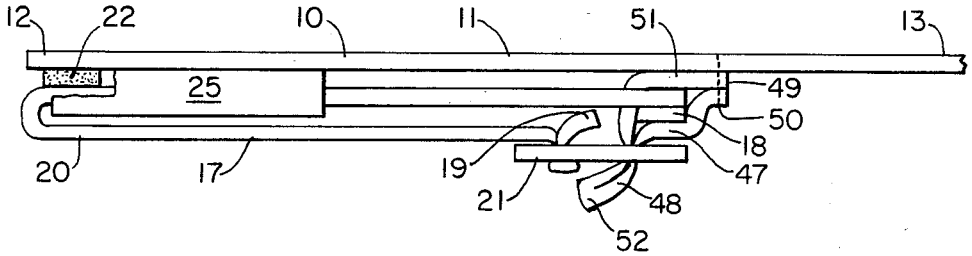
FIG. 9 is a top view of the alternative embodiment of FIG. 8.

FIGS. 8 and 9 show another alternative embodiment for associating the belt 17 to the gown body 10. Loop 47 functions as the means for releasably attaching both the first end 18 of the belt 17 and the transfer device 21. The loop 47 is formed by a piece of fabric 48 folded back upon itself, both ends 49 permanently attached to the front portion 11 of the gown body 10 at the same point. The loop 47 may be attached by any conventional securing means such as a sewn stitch 50. This configuration creates a proximal end 51 and a distal end 52. The proximal end 51 releasably attaches the belt 17 by receiving the first end 18 and a segment of the middle section 20 of the belt 17 in a folded configuration, such as by folding the belt 17 back upon itself. The distal end 52 of the loop 47 releasably attaches the transfer device 21 in the same way as tab 24 of FIG. 6.

The gown incorporating the alternative embodiment shown in FIGS. 8 and 9 is donned in the same manner as the gown embodiment of FIG. 1 except that the wearer releases the transfer device 21 from the distal end 52 of loop 47, and removes the folded configuration of the first end 18 and the middle section 20 of the belt 17 from the loop 47.

While particular embodiments of the present invention have been illustrated and described, those skilled in the art will recognize that various changes and modifications can be made without departing from the spirit and scope of the invention. It is intended to cover, in the claims, all such modifications that are within the scope of this invention.

What is claimed is:

1. A surgical gown of the rear-closure type, comprising:

a gown body, said gown body having a front portion, a first back margin, and a second back margin;

a belt, said belt having a first end, a second end and a middle section; and means for associating said belt with said gown body, said means comprising means for releasably attaching a segment of said middle section of said belt to said gown body; means for releasably attaching said first end of said belt to said front portion of said gown body; a transfer device; means for releasably attaching said transfer device to said front portion of said gown body; and means for releasably attaching said second end of said belt to said transfer device.

2. The gown of claim 1 further comprising means for engaging said belt in a slidable relation with said gown body so that said belt has both vertical and circumferential degrees of freedom with respect to said gown body.

3. The gown of claim 2 wherein said means for engaging said belt comprises a belt hanger attached to said gown body.

4. The belt hanger of claim 3 wherein said belt hanger is of a generally rectangular shape and is configured and disposed to circumferentially extend from said first back margin to said front portion of said gown body.

5. The gown of claim 1 wherein said means for releasably attaching a segment of said middle section of said belt to said gown body comprises tension separable means.

6. The gown of claim 5 wherein said tension separable means comprises double-sided adhesive tape.

7. The gown of claim 6 wherein one surface of said double-sided adhesive tape is attached to said first back margin of said gown body.

8. The gown of claim 1 wherein said means for releasably attaching said first end of said belt to said front portion is a loop attached to said front portion, said loop receiving said first end and a segment of said middle section of said belt in a folded configuration.

9. The gown of claim 8 wherein said means for releasably attaching said transfer device to said front portion is a tab attached to said front portion, said tab comprising a distal end which is configured to releasably engage said transfer device and a proximal end attached to said front portion of said gown body.

10. The gown of claim 9 wherein said means for releasably attaching said first end of said belt to said front portion and said means for releasably attaching said transfer device to said front portion are combined in a unitary belt end holder.

11. The gown of claim 8 wherein said means for releasably attaching said transfer device to said front portion is said loop, said loop comprising a distal end which is configured to releasably engage said transfer device and a proximal end attached to said front portion.

12. The gown of claim 1 wherein said means for releasably attaching said transfer device to said front portion is a tab attached to said front portion of said gown body, said tab comprising a distal end which is configured to releasably attach said transfer device and a proximal end attached to said front portion..

13. The gown of claim 1 wherein said means for releasably attaching said second end of said belt to said transfer device comprises said transfer device having an opening through which said second end of said belt may be looped to releasably attach said second end.

* * * * *